United States Patent [19]

Izzi, Sr.

[11] Patent Number: 4,637,422

[45] Date of Patent: Jan. 20, 1987

[54] PLASTIC WASHING MACHINE BOX WITH HINGED MOUNTING BRACKETS

[75] Inventor: Lewis B. Izzi, Sr., Shelby, N.C.

[73] Assignee: Plastic Oddities Inc., Shelby, N.C.

[21] Appl. No.: 819,257

[22] Filed: Jan. 16, 1986

[51] Int. Cl.[4] ..... F16L 5/00

[52] U.S. Cl. ..... 137/360; 220/4 R; 248/27.1

[58] Field of Search ..... 137/360; 52/27; 220/4 R, 307; 248/27.1, 56, 558, DIG. 6

[56] References Cited

U.S. PATENT DOCUMENTS

| | | | |
|---|---|---|---|
| 1,800,173 | 4/1931 | Anderson | 220/307 |
| 2,497,827 | 2/1950 | Trafton | 220/307 |
| 2,751,173 | 6/1956 | Fredriksen | 248/27.1 |
| 3,096,782 | 7/1963 | Williams | 137/360 |
| 3,445,052 | 5/1969 | Lewallen | 229/16 R |
| 3,718,154 | 2/1973 | Doumany | 137/360 |
| 3,831,624 | 8/1974 | Doumany | 137/360 |
| 3,834,781 | 9/1974 | Logsdon | 312/229 |
| 3,847,175 | 11/1974 | Anderson | 137/360 |
| 3,862,433 | 1/1975 | Rousselet | 137/360 |
| 3,871,723 | 3/1975 | Pray | 248/56 |
| 3,996,959 | 12/1976 | Caruth | 137/360 |
| 4,158,471 | 6/1979 | Logsdon | 137/360 |
| 4,328,903 | 5/1982 | Baars | 248/27.1 |
| 4,410,004 | 10/1983 | Kifer et al. | 137/360 |
| 4,564,249 | 1/1986 | Logsdon | 137/360 |

*Primary Examiner*—Martin P. Schwadron
*Assistant Examiner*—Sheri M. Novack
*Attorney, Agent, or Firm*—Laurence R. Brown

[57] ABSTRACT

A plastic molded laundry interface box serving as a connection junction box between plumbing connections in a wall and a washing machine is integrally provided with features including hinged mounting brackets, reversible mounting positions for connection to downward or upward extending water pipes, preformed holes for adaption to multiple mounting postures having removable insert plugs in nonused holes, and cover plate structure permitting adjustment for various thickness walls. These features are coordinated to permit installation in the least amount of time without special tools and to facilitate storage in limited space while conforming to various locations of inwall plumbing pipes of different sizes. The preferred embodiment is a one piece integral plastic box with plastic springs attaching the hinged brackets thereto.

13 Claims, 3 Drawing Figures

PLASTIC WASHING MACHINE BOX WITH HINGED MOUNTING BRACKETS

TECHNICAL FIELD

This invention relates to washing machine connection junction boxes for coupling plumbing connections in a wall to a washing machine, and more particularly it relates to integral plastic molded washing machine boxes adaptable to various plumbing pipe locations in the laundry room walls.

BACKGROUND ART

Washing machine outlet boxes of the prior art have introduced various features intended to resolve the special mounting and connecting problems of this particular product line. However, as hereinafter discussed, the various structures of the prior art have failed to resolve some of the basic mounting, installation and interconnection problems and have used structure that of itself has either introduced further problems or limited the range of usefulness. Examples of such art are now discussed.

U.S. Pat. No. 3,096,782, J. W. Williams, July 9, 1963 provides a substantially rectangular open front box having only one orientation with a lowermost panel funnelized for a drainpipe outlet. A coverplate mounts directly on the box which extends to a position flush with the laundry room wall, therefore limiting the box with affixed mounting brackets to installation on a wall of known thickness.

U.S. Pat. No. 3,718,154, C. R. Doumany, Feb. 27, 1973, provides for mounting water pipe connections on bosses extending upwardly above a lower positioned drain hole from a lowermost panel to prevent water drainage around the water pipes. The box is metal requiring a special drainpipe connection to be formed on a drain hole of special design, not adaptable to plastic boxes, nor for connection to plastic piping by plastic welding.

U.S. Pat. No. 3,831,624, C. R. Doumany, Aug. 27, 1974 has a plastic box and outlet drain pipe, still subject to the problems of mounting with variable thickness walls.

U.S. Pat. Nos. 3,834,781, D. D. Logdson, Sept. 10, 1974 and 3,847,175, K. J. Anderson, Nov. 12, 1974, provide a set of knockout holes for various water pipe locations, in one case including the lowermost drain pipe in a plastic box. Such knockouts, however, not only significantly increase the installation time, probable requiring special tools, but more importantly, they subject the basic box to damage and disfiguration and probably unwanted water leakage.

U.S. Pat. Nos. 4,410,004, D. F. Kifer et al, Oct. 18, 1983 and 4,158,471, D. D. Logsdon, June 19, 1979, address the problem of mounting the boxes on the studs to conform with variable wall thicknesses presented by all the foregoing art and thus provide removable and adjustable mounting brackets for plastic boxes.

In general none of this art provides a box that may be efficiently installed in little time without special tooling or trimming to match various wall thicknesses and plumbing locations. Most are awkward to pack and assemble, taking up excess storage room and conducive to missing or lost parts. most are not capable of both water drainage and dryer venting.

It is therefore a general objective of this invention to provide a superior unit offering a combination of features not found together in any of the prior art washing machine boxes, and solving problems in the art not addressed by the prior art.

DISCLOSURE OF THE INVENTION

The significant unresolved problems of washing machine boxes, namely: the time consumed in installation, the propensity for damage in installation, the necessity to have and to assemble various parts, and the requirment of excess storage space for boxes in inventory, are overcome by provision of a single piece molded plastic box complete with holes for water and drain pipes and hinged brackets that may be folded alongside box walls for storage and nailed onto studs in use.

Other desirable features include damage proof and time saving pipe terminal locations with preformed holes adaptable to various box positioning having removable plugs for unused ones of a set of universal holes. Top and bottom outlet hole locations permit reversing the box for water pipes from either above or below the box, leaving an upper hole useable as a vent. Simple inexpensive plastic pipe coupling means for outlet drain pipes of different sizes simply provides a water tight seal.

The front box opening lies in a plane defined by the hinged brackets extending perpendicular to the box side walls, flush with mounting wall studs. A front plate cover mating snugly inside the front box opening adapts to various thickness walls by means of a flange extending from the cover mounted on the outer surface of the mounting wall to extend through walls of various thickness when fastened to the box.

BRIEF DESCRIPTION OF THE DRAWINGS

In the accompanying drawings, wherein like reference characters are used throughout the various views for similar features to facilitate comparison, a preferred embodiment of the invention is set forth, showing.

THE PREFERRED EMBODIMENT

Figure 1:
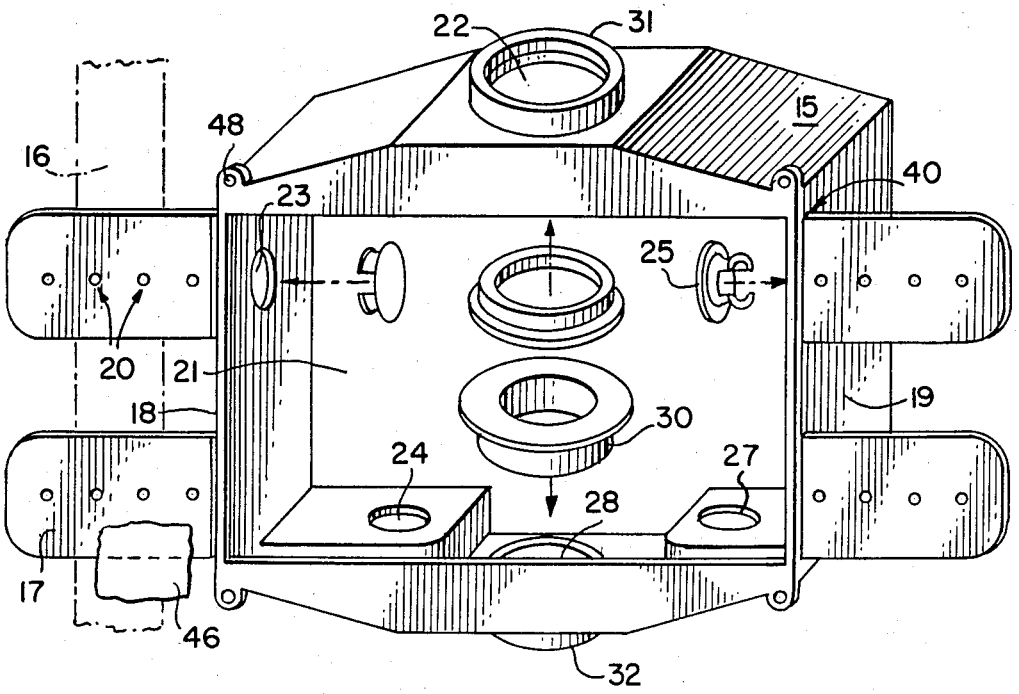
In FIG. 1, a perspective view looking into the front of a laundry connection box downwardly toward a water drain pipe outlet.

As may be seen from FIG. 1, the laundry interface box 15 serves as a connection junction box between plumbing connections in a wall mounted on the studs 16 to which are affixed the generally planar bracket panels 17, extending contiguously from the box 15 opposite side walls 18 and 19 to abut a common plane with the front opening face of the box 15 upon which wallboard is mounted, by nailing through holes 20.

The four sidewalls defining the open front box 15, extend substantially perpendicular from the closed back panel 21. Thus the framework forming the box 15 is adapted for molding in one piece of a plastic material such as polypropylene, complete with the brackets 17. A set of holes 22, 23, 24, etc. are formed in the box in locations adapted to terminal plumbing connections to water, drain and vent pipes in the wall defined by studs 16. Elastically inserted and removed plugs 25 provide for closure of those holes not used in a particular installation, so that the box 15 mounted in recessed position inside the wall is closed to prevent entrance of dust or insects, and is accessible only from the laundry room wall through the front cover plate 26 of FIG. 2. Note that the respective hole sets 23 and 24 provide access ports for connection of water pipes extending either horizontally or vertically in the wall defined by the studs 16.

When the water pipe terminals come from below the box into holes 24, water leakage within the box 15 does not tend to get out of the box and leak down the pipes because of the raised platforms 27, and the location of the drain outlet 28 to exhaust water from the lowermost position of the lower box wall. When the hole set 24 is used for the water pipe connections the plugs 25 are detented in the hole set 23.

In the outlet access ports 22 or 28, the flanged cylindrical drainage coupling member 30 is force fit into a resident position 31 or 32. For this purpose, as better seen from FIG. 2, the edge of the outlet holes may be feathered or tapered as indicated by the notation 33,34 to provide a snug and watertight frictional fit with the cylindrical coupling member body.

A particularly advantageous feature of this cylindrical coupling member is that it is made of the same plastic (poly vinyl chloride) used for the plastic drain pipes to which the box is connected for plastic weld connections thereto, and thus the inner and outer diameters of the coupling 30 cylindrical diameter are dimensioned to fit two different sizes of drain pipes.

In accordance with this invention the box and hinges are molded in one integral piece, complete with the brackets 17, wherein the brackets 17 are hinged to pivot between respective positions (a) parallel to and adjacent the adjoining side wall to which the bracket is attached for compact storage of the box in a minimum space and (b) perpendicular to the side walls a shown in the drawing for attachment to the studs. Thus the hinged brackets cooperate with the other box features to provide a combination of interacting features not before available in the art. While unitary single piece construction is not necessary for the hinged bracket feature, the price of such plumbing fittings as the box is critical and a one piece plastic molded unit is the preferred embodiment.

Accordingly a plastic hinge is formed at the junction of the sidewalls 18 and 19 with the bracket panels 17 shown as the indentation 40. Polypropylene, for example, is thus used for the box, with the integral hinge formed in the manner taught in U.S. Pat. No. 3,445,052, May 20, 1969.

Figure 2:
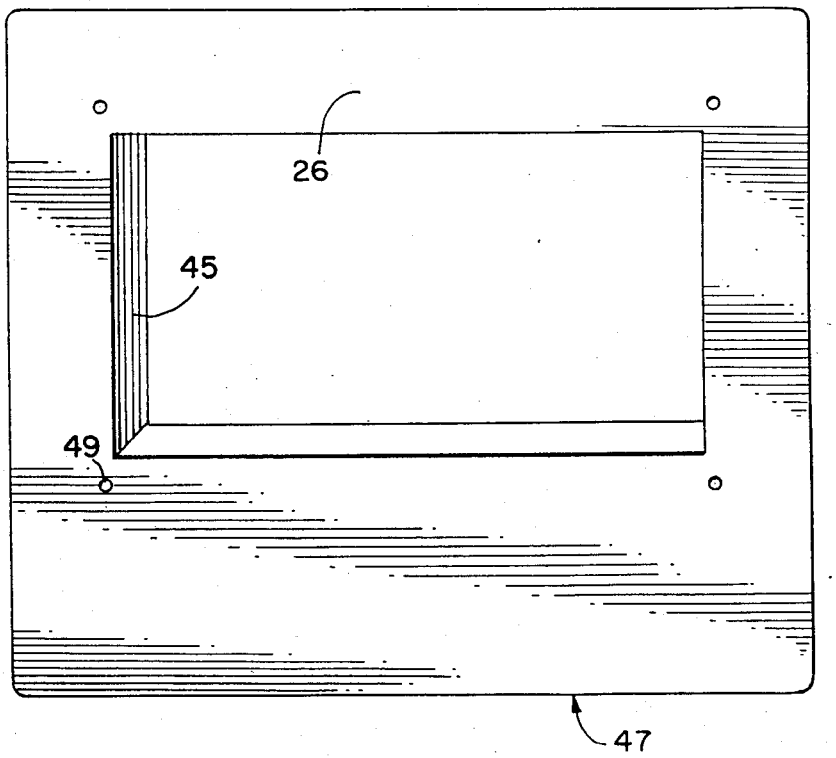
In FIG. 2, a perspective view from the front of a cover plate adapting the box to accomodate walls of various thickness with a single hinge mounting position; and in FIG. 3, a perspective front view into the box opening looking upwardly toward an outlet for venting a dryer, with the box upside down from the FIG. 1 view.

As shown in FIG. 2, the decorative cover plate 26 has flanges 45 typically one inch (2.54 cm) wide, which snugly mate inside the four side walls of the box 15 to seal it except for the outer surface rectangular access opening through which washing machine drains and water hoses may be passed for connection inside the box. The wide flange 45 is critical in that it permits the brackets to be fixed in one position on the box, preferably flush with the plane defined by the open box front, and yet be installed universally on laundry room walls 46 (FIG. 1) of various thickness attached to studs 16. Thus, the flat panel plate 47 of the cover may abut the outer surface of the wall 46, whether it has a thickness of three-eighths inch (one cm) or three-fourths inch (two cm), when bracket 17 is nailed to stud 16. Mating mounting means comprising holes 48 in the box 15 and holes 49 in the cover plate 26 permit a screw to mount the cover in place.

Figure 3:
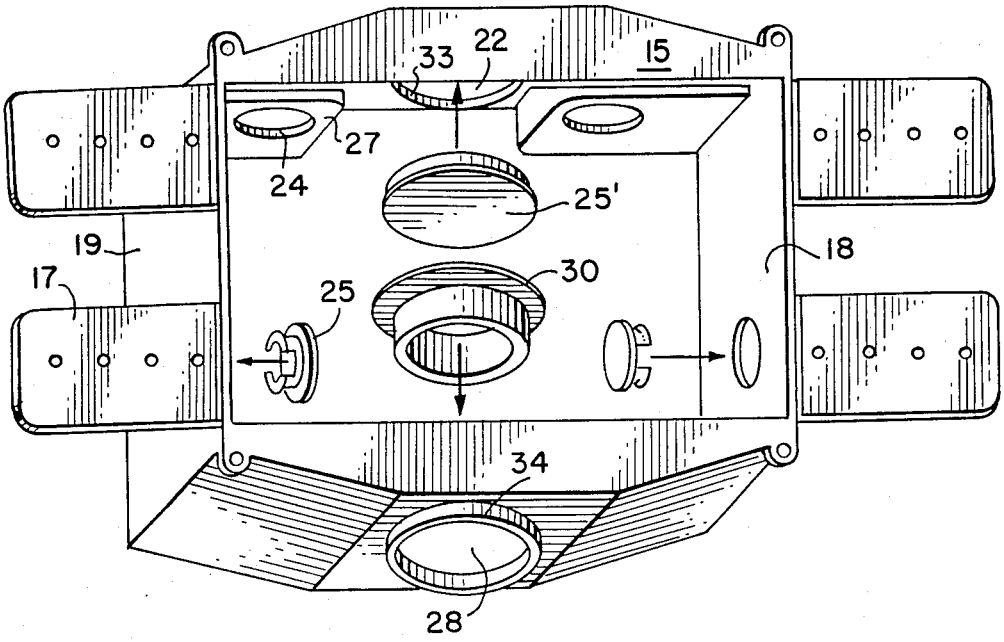

From FIG. 3 it is seen that the box 15 can be mounted upside down from the FIG. 1 view whenever the water pipes come from above the box to mate in hole set 24. It is also noted that the downwardly directed funnelling structure for draining water out of either of the centrally located holes 22 or 28, when mounted in the lowermost wall is provided. If the upper hole, in this orientation 22, is not used as a vent the removable plug 25' closes it. These detentable plugs are quickly removed or installed by a plumber without any special tooling and cannot damage or tear the plastic box.

It is therefore evident that this invention provides a laundry interface box having many features and advantages not available in the prior art, and therefore those novel features believed indicative of the nature and spirit of the invention are defined with particularity in the following claims.

I claim:

1. A laundry interface box serving as a connection junction box between plumbing connections in a wall and a washing machine adapted for recessed installation on the studs of a laundry room wall, comprising in combination, a framework forming a box with a front opening, a back panel and four side walls extending substantially perpendicular from the back panel, a set of holes extending through the walls adapted for terminal plumbing connections to water and drain pipes located in the laundry room walls, and a plurality of substantially planar brackets for attachment of the box to the studs of the laundry room wall with each bracket pivotably attached to a side wall of the box to pivot between respective positions parallel to and adjacent the side wall to which the bracket is attached for compact storage of the box and perpendicularly extending from the side wall away from the box for attachment thereof to a wall stud.

2. The box defined in claim 1 further comprising means for installing the box on the wall studs in either of two positions with the brackets extending substantially horizontally to mate with different positions of plumbing pipes in the laundry room wall by interchange of the top and bottom ones of said sidewalls, wherein the top and bottom ones of said sidewalls each define a hole centrally positioned in a water funneling zone serving when positioned as the bottom sidewall as a water drain outlet.

3. The box defined in claim 2 having two water pipe connection holes residing in only one of the said top and bottom sidewalls, and a further pair of water pipe connection holes residing in the sidewalls containing the brackets.

4. The box defined in claim 3 having detented plugs positioned in at least two unused ones of the holes.

5. A laundry interface box for serving as a connection junction box between plumbing connections in a wall and a washing machine and provided with means for recessed installation on the studs of a laundry room wall, comprising in combination, a framework forming a box with a front opening, a back panel and four side walls extending substantially perpendicular from the back panel, bracket means extending from two of the walls for mounting onto the studs, and funnelling structure on each of the remaining two walls leading to exhaust holes defined in a central location on the respective walls to thereby exhaust water from a lowermost position in the box, when the box is mounted on the studs with either of the remaining said walls lowermost.

6. A laundry interface box for serving as a connection junction box between plumbing connections in a wall and a washing machine and provided with means for recessed installation on the studs of a laundry room wall, comprising in combination, an integral plastic framework forming a box with a front opening, a back panel, four side walls extending substantially perpendicular from the back panel and brackets formed on two opposite ones of the side walls with plastic hinging structure permitting the brackets to be positioned both in a position parallel to and adjacent to its adjoined sidewall in a packing position and in a position perpendicular to and extending outwardly away from its adjoined sidewall in a stud mounting position.

7. The box defined in claim 6 wherein the side walls terminate in a common plane, and said brackets in their perpendicular position substantially abut the common plane thereby to install the common plane substantially at the inner surface of a wall affixed to the studs.

8. The box defined in claim 7 including means for affixing a cover plate to the front opening of the box, and a mating decorative cover plate having a substantially rectangular front opening with flanges substantially one inch in width extending therefrom into the front opening to mate along the side walls of the box, thereby to afford a cover plate adaptable for abutting the outer face of walls of variable thickness placed on the studs without visibly displaying a gap between the box and the wall surface.

9. The box defined in claim 6 wherein the two opposite side walls without brackets each have a generally centrally located hole defined therein of such diameter to form a close friction water tight fit with a substantially cylindrical mating plastic flanged sleeve.

10. The box defined in claim 10 wherein the plastic flanged sleeve has inner and outer diameters of respective sizes to be plastic welded to mating drain pipes of standard size.

11. A laundry interface box for serving as a connection junction box between plumbing connections in a wall and a washing machine adapted for recessed installation on the studs of a laundry room wall, comprising in combination, an integral plastic framework forming a box with a front opening, a back panel and four side walls extending substantially perpendicular from the back panel, a set of holes defining in each wall a mounting position for mating with plumbing in the laundry room wall, and a set of removable plugs for mating into and closing a subset of unused holes in a single molded piece including integral plastic bracket members of substantially flat panel shape extending from two opposite ones of the side walls having plastic hinging structure permitting the bracket panels to be optionally manually positioned alternatively in positions parallel to and adjacent the outer surface of the side walls in a storage position and perpendicular to the sidewalls and extending outwardly in a position for mounting on the wall studs.

12. A laundry interface box for serving as a connection junction box between plumbing connections in a wall and a washing machine adapted for recessed installation on the studs of a laundry room wall, comprising in combination, a washing machine plumbing connection box with a front opening, a back panel, four side walls extending outwardly from the back panel to define said front opening, access ports for receiving therein plumbing terminals located within said wall, and substantially flat panel like brackets extending from two opposite side walls for mounting the box on said studs, and hinge structure permitting the brackets to hinge between positions substantially parallel to and perpendicular to said back panel.

13. The box defined in claim 12 wherein the box and brackets are molded in a single plastic body including integral plastic hinges between the brackets and the respective two opposite side walls from which they extend.

* * * * *